United States Patent [19]

Matsuura et al.

[11] 4,190,514

[45] Feb. 26, 1980

[54] ELECTROLYTIC CELL

[75] Inventors: Shunji Matsuura, Tokuyama; Toshio Oku, Yamaguchi; Masaaki Kurumatani, Tokuyama; Nobuyuki Kuramoto, Tokuyama; Yasutaka Ozaki, Tokuyama, all of Japan

[73] Assignee: Tokuyama Soda Kabushiki Kaisha, Yamaguchi, Japan

[21] Appl. No.: 912,987

[22] Filed: Jun. 6, 1978

[30] Foreign Application Priority Data

Jun. 6, 1977 [JP] Japan ..... 52-65854
Oct. 28, 1977 [JP] Japan ..... 52-128794

[51] Int. Cl.[2] ..... C25D 3/12; C25B 11/02

[52] U.S. Cl. ..... 204/242; 204/49; 204/290 R; 204/292

[58] Field of Search ..... 204/290 R, 49, 242, 204/292

[56] References Cited

U.S. PATENT DOCUMENTS 3,257,294 6/1966 Michael ..... 204/49
4,080,278 3/1978 Ravier et al. ..... 204/290 R

FOREIGN PATENT DOCUMENTS 47-22945 3/1972 Japan .

*Primary Examiner*—R. L. Andrews
*Attorney, Agent, or Firm*—Wenderoth, Lind & Ponack

[57] ABSTRACT

An electrolytic cell equipped with a cathode, said cathode comprising a supporting structure composed of iron, nickel or an alloy of such a metal and a nickel coating formed thereon by electroplating in the presence of at least one S/N substance selected from the group consisting of a thiocyanate ion, a thiosulfate ion, a dithiocarbamate ion, a thiocarboxylate ion, an amino acid ion, a thiocarbamoyl compound and thiourea.

8 Claims, 1 Drawing Figure

HYDROGEN OVERVOLTAGE AT CATHODE (V)
0.4
0.3
0.2
0.1
10
20
30
40
50
NUMBER OF DAYS

ELECTROLYTIC CELL

This invention relates to an electrolytic cell, and specifically to an electrolytic cell suitable for the production of an alkali hydroxide and chlorine by electrolysis of an alkali metal halide, especially sodium chloride or potassium chloride.

The electrolysis industry has covered a wide range of activities including the production of alkalies, halogen gases and hydrogen gas, and the electrochemical production of adiponitrile. One of the important problems of this industry is to reduce the amount of electric power consumption, and for this purpose, the development of electrolytic cells equipped with cathodic substances having a low hydrogen overvoltage has been desired. Another problem is to increase the durability of the electrodes used in such an electrolytic cell.

It is an object of this invention to provide an electrolytic cell equipped with a new cathode for the purpose of solving these two problems.

The present invention provides an electrolytic cell equipped with a cathode, said cathode comprising a supporting structure composed of iron, nickel or an alloy of such a metal and a nickel coating formed thereon by electroplating in the presence of an S/N substance to be defined hereinbelow.

The coating of nickel preferably has a thickness of 5 to 100 microns.

The electrolytic cell of this invention is suitable for electrolyzing an alkali metal halide using an ion exchange membrane as a diaphragm. A preferred diaphragm for use in this electrolysis is an ion exchange membrane including a perfluorocarbon as a main chain with side-chain carbon atoms having an ion exchange group bonded thereto, each of which carbon atoms has at least one fluorine atom bonded thereto.

Preferably, in the production of the cathode used in this invention, a nickel coating is formed on a supporting structure by electroplating in accordance with at least one of the following procedures (A), (B) and (C).

(A) To use a supporting structure consisting of a base structure composed mainly of iron or nickel and a 2 to 20 micron-thick coating of copper and/or zinc formed on the base structure. A cathode having higher durability may be obtained by heat-treating the structure at 300° to 600° C. after the nickel coating has been formed on it.

(B) To use a supporting structure having such a shape that it does not contain any flat area which extends over more than 10 mm both in the longitudinal and transverse directions, preferably a supporting structure composed of a porous plate.

(C) To form the nickel coating by electroplating from a plating bath which contains (i) a nickel ion, (ii) a complexing agent, (iii) an ammonium ion and/or a boric acid ion, and (iv) as an S/N substance, at least one member selected from the group consisting of a thiocyanate ion, a thiosulfate ion, a dithiocarbamate ion, a thiocarboxylate ion, an amino acid ion, a thiocarbamoyl compound and thiourea.

The present invention is described below in detail. Some terms used in the present specification and the appended claims are defined as follows:

The "S/N substance" is a generic term which denotes substances capable of forming in water a sulfur ion, an anion composed of two or more elements one of which is sulfur (except a sulfate ion), and an anion having an N-C bond.

The "flat area" denotes not only an area free from depressed and raised portions, but also an area which is curved with the same radius of curvature. In the latter sense, the length corresponding to two times the radius of curvature is taken as the extent of the flat area. For Example, the extent of the flat area of a cylinder having a diameter R (mm) in the transverse direction (i.e., the direction at right angles to the cylindrical axis) is R (mm). Accordingly, a cylindrical electrode having a diameter of less than 10 mm and a cathode consisting of a plurality of such cylindrical electrodes aligned in parallel to each other meet the configurational requirement specified in (B) above, and can be conveniently used in the present invention.

The "complexing agent" denotes an organic compound which in an electroplating bath, at least partly dissociates as an anion and forms a complex with a nickel ion.

The "electrolysis of an alkali metal halide which involves the use of an ion exchange membrane as a diaphragm" denotes an electrolytic method which comprises using a cell having an anode compartment and a cathode compartment partitioned by a cation exchange membrane substantially impermeable to an aqueous solution, causing an aqueous solution of an alkali metal halide to be present in the anode compartment and an aqueous solution of sodium hydroxide in the cathode compartment, and passing an electric current across the anode and the cathode thereby to form sodium hydroxide in the cathode compartment and a halogen gas such as chlorine gas in the anode compartment.

DESCRIPTION OF DRAWINGS

The single FIGURE of drawing is a graph of the results demonstrated in Example 2 and shown in Table 2.

Cathodes heretofore used in an electrolytic cell include those which are obtained by applying a platinum-group metal to mild steel, nickel or a structure of mild steel or nickel by electroplating or electroless plating. Mild steel has been in general use in view of the relatively low equipment cost and its good durability. A cathode composed of mild steel, however, shows a relatively high hydrogen overvoltage, and is desired to be further improved in order to reduce the amount of powder consumption required for electrolysis. Nickel also produces the same degree of hydrogen overvoltage as mild steel, and moreover, a nickel cathode itself is not industrially advantageous.

Figure 1:
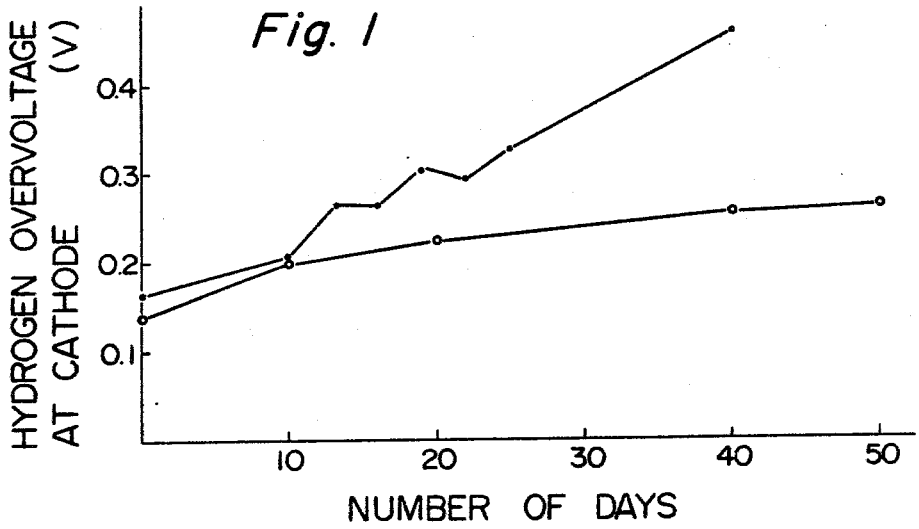

A cathode obtained by coating nickel on a supporting structure of iron may be suggested. For example, a cathode obtained by applying nickel on mild steel by electroplating from a so-called Watts bath shows almost the same degree of hydrogen overvoltage as the nickel cathode. A cathode obtained by electroless plating of nickel on mild steel can sometimes decrease hydrogen overvoltage to a somewhat greater degree than the nickel cathode. However, the degree of decrease is small and its durability is low, and we do not know any successful use of such a cathode on a commercial basis.

A cathode obtained by coating a platinum-group metal on mild steel is fairly expensive, and is commercially unsuitable unless it has a long life. However, as far as we know, no platinum-coated cathode having a long life has been provided.

The present invention provides an electrolytic cell equipped with a cathode comprising a supporting structure of iron, nickel or an alloy of such a metal and a coating of nickel formed on the surface of the structure by electroplating in the presence of an S—/N— substance, which shows a fairly low hydrogen overvoltage and has high durability.

Our experience tells that even when a combination of the supporting structure and a substance to be coated on it is the same, for example when nickel is coated on iron, the cathode performance (hydrogen overvoltage and durability) of the resulting cathode greatly vary according to the method of coating.

We presume that the difference in the method of production will bring about a chemical or physical difference of the surface of the resulting cathode, which in turn affects the performance of the resulting cathode. No clear reason, however, has been able to be assigned to it. Accordingly, in the present application, the cathode obtained shall be specified by specifying the method of its production.

One preferred embodiment of the present invention involves the use of a cathode which is produced by electroplating a nickel coating on a supporting structure composed of iron, nickel, or an alloy composed mainly of at least one of these metals from an electroplating bath containing as the S/N substance at least one member selected from the group consisting of a thiocyanate ion, a thiosulfate ion, a dithiocarbamate ion, a thiocarboxylate ion, an amino acid ion, a thiocarbamoyl compound and thiourea (the thiocarbamoyl group and the group

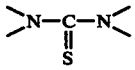

are regarded as anions), especially preferably the thiocyanate ion.

The coating on the cathode has a thickness of preferably 5 to 100 microns, especially 5 to 30 microns. If the coating thickness is less than 5 microns, the loss of the cathodic activity owing to the consumption of the coating layer occurs at an early stage, and the cathode has poor durability. If the coating thickness is too small, the activity of the cathode is naturally low. On the other hand, if the thickness exceeds 100 microns, a greater effect cannot be expected, and there is an increasing possibility of the peeling of the coating.

Nickel plating in this invention can be performed by using known conventional plating methods and apparatus without modification. Those skilled in the art well know these methods and apparatus except that the electroplating bath contains a substantial amount of an S/N substance typified by a thiocyanate ion ($SCN^-$). Generally, the S/N substance should be present in the nickel electroplating bath in an amount of at least ½ ion equivalent, preferably at least 1 ion equivalent or at least 1 mole equivalent, per equivalent of nickel present as an ion in the bath. Hence, the simplest bath composition is a solution of nickel thiocyanate in water. The electroplating is carried out generally from a plating bath containing nickel thiocyanate in a concentration ranging from 100 g/liter to saturation using the supporting structure (to be electroplated) as a cathode and a nickel anode or an insoluble anode (e.g., an anode resulting from the coating of platinum or titanium) at a temperature of 0° C. to the boiling point of the solution, preferably from room temperature to 50° C. at a pH of 3 to 9 and a current density of about 1 to 30 A/dm$^2$. The bath may contain other chemicals such as complexing agents and pH adjusting agents. The nickel ion and the thiocyanate ion may also be supplied from separate compounds. For example, the thiocyanate ion may be supplied by water-soluble thiocyanate compounds such as ammonium thiocyanate, potassium thiocyanate or sodium thiocyanate. The nickel ion may be supplied by nickel sulfate, nickel chloride, anodic polarization of a nickel metal, etc.

However, with a nickel plating bath containing substantially only a thiocyanate ion and a nickel ion, for example a solution of nickel thiocyanate in water, it is difficult, if not impossible, to form a firmly adhering nickel coating directly on iron or nickel. Thus, the resulting cathode is frequently poor in durability, and the performance of the cathode is difficult to stabilize.

One feasible means of increasing the adhesion strength of the coating is to plate copper or zinc on a base structure composed of iron or nickel or an alloy of such a metal to form a composite supporting structure, and then perform a nickel electroplating on the composite supporting structure from a nickel plating bath containing an S/N substance such as a thiocyanate ion and a nickel ion. In the present application, such a composite supporting structure also comes within the definition of the supporting structure composed of iron, nickel or an alloy of such a metal.

An additional means for increasing the durability of the cathode used in this invention comprises coating the same base structure with copper or zinc in a thickness of 2 to 20 microns, then coating nickel on the resulting supporting structure by using a nickel plating bath containing a thiocyanate ion and a nickel ion, and heat-treating the resulting product at a temperature of 300° to 500° C. Usually, the suitable heat-treating time is 0.5 hour to ten and several hours. The heat-treatment causes copper or zinc of the interlayer to diffuse into the base structure and the coating to form an alloy and thus substantially disappear.

Still another means is to use a supporting structure of a specified configuration. When nickel is electroplated on a support consisting of iron, nickel or an alloy of these in the presence of an S/N substance such as a thiocyanate ion, the resulting nickel layer has poor adhesion. Investigations of the present inventors, however, have led to the discovery that the electroplated layer shows a relatively good adhesion to a support having the same composition as above but having many raised and depressed areas. The present inventors have found that for example, in order to obtain an industrial cathode having a large area which extends over a length of more than 500 mm in two directions, many raised and depressed portions, or pores are formed on the surface of the supporting structure, and the resulting cathode has sufficient durability to withstand practical use. Thus, one effective means of performing the present invention is to use a supporting structure which is substantially free from any flat area which extends over more than 10 mm both in the longitudinal and lateral directions.

In plating, it is the usual practice to etch the support chemically or mechanically so as to increase the adhesion of the coating. Etching is also effective in the present invention. However, if the raised and depressed portions on the surface of the support are microscopic in size as obtained by etching, no effect is produced. If the nickel coating layer has a thickness of 5 to 30 microns, the sizes of the raised and depressed portions must be at least about 500 microns. Especially preferably, the supporting structure is a mesh-like article, expanded metal, longitudinal lattice structure or other porous plate, which has a rod-like portion having a circumferential length of less than 20 mm in many parts of the supporting structure.

Another preferred means of forming a nickel coating is to use an electroplating bath containing (i) a nickel ion, (ii) a complexing agent, (iii) an ammonium ion or a boric acid ion, and (iv) an S/N substance such as thiosulfate compounds, dithiocarbamic acid compounds thiocarboxylic acid compounds, amino acid compounds, thiocarbamoyl compounds, thiourea and thiocyanate compounds. The proportions of the constituent components can vary relatively broadly, and usually the preferred ranges of the proportions are as tabulated below.

| Composition | Mole ratio | Specific example 1 | Specific example 2 |
|---|---|---|---|
| Nickel ion | A mole/l | 0.5 mole/l | 0.1 mole/l |
| Complexing agent | A–5A mole/l | 0.5 mole/l | 0.32 mole/l |
| Ammonium ion or boric acid ion | A–20A mole/l | 0.9 mole/l | 0.9 mole/l |
| S/N substance | 0.1A–3A mole/l | 0.5 mole/l | 0.1 mole/l |
| pH | 3 – 9 | 8 | 8 |

In addition to these ingredients, a hetero metal ingredient such as sodium tungstate may be added.

The complexing agent is generally a hydroxycarboxylic acid or a soluble salt of a hydroxylcarboxylic acid. Specific examples include glycoloic acid, lactic acid, ethyleneacetic acid (β-hydroxypropionic acid), glyoxalic acid, tartaric acid, malic acid, tartronic acid, citric acid and gluconic acid.

An ammonium ion and a boric ion may be present together. Sources of an ammonium ion may be ammonia and ammonium chloride, and borax may be used as a source of boric acid ion. The pH of the bath can be maintained constant by using a combination of ammonia and an ammonium halide or a combination of boric acid and borax.

Examples of the S/N compound are sodium thiosulfate, potassium thiosulfate, amino acids such as nicotinic acid or its salts, thiocyanate compounds such as potassium thiocyanate, sodium thiocyanate, ammonium thiocyanate, nickel thiocyanate and cobalt thiocyanate, thioacetamide, ethyl thiocarbamoylformate, thioacetic acid, 2-thiophenecarboxylic acid, thiourea, sodium thiomalate and dithiocarbamic acid.

By using the nickel plating bath described above, a cathode having an equivalent performance to that obtained by using a nickel electroplating bath containing a thiocyanate ion alone, and nickel can be deposited firmly on a flat supporting structure composed of iron or nickel with a high adhesion strength that can withstand use as a cathode.

The specific means described above can be used either alone or in combination.

Since the cathode used in this invention is very active, it has a weak resistance to an oxidizing atmosphere. Accordingly, when it is used in an electrolytic cell for electrolyzing an alkali metal halide such as sodium chloride, the activity of the cathode is possibly affected by an oxidizing substance such as hypochlorous acid ascribable to chlorine evolved at the anode. With a cathode comprising the composite supporting structure consisting of a base structure of iron, nickel or an alloy of such a metal and a coating of copper or zinc formed on its surface, the interlayer of copper or zinc is likely to be attacked by an alkali solution, and therefore, the durability of the cathode will be insufficient.

In view of the foregoing, it is preferred to use an electrolytic cell for electrolysis of an alkali metal halide in which an ion exchange membrane is provided as a diaphragm. The use of an ion exchange membrane makes it possible to protect the cathode from an oxidizing atmosphere such as a hypochlorite ion. An ion exchange membrane conveniently used for this purpose is the one which has a perfluorocarbon as a main chain with side-chain carbon atoms having an ion exchange group such as a sulfonic group, a carboxyl group, or both, each of which carbon atoms having at least one fluorine atom bonded thereto. This type of ion exchange membrane is conmercially available, for example, under the trademark "Nafion" (a product of E. I. du Pont de Nemours & Co.).

Other component parts of the electrolytic cell of the present invention and materials therefor may be those which have been known heretofore. For example, an anode having good dimensional stability, such as the one consisting of a titanium base and a coating of a platinum-group metal oxide, can be used.

The following Examples illustrate the present invention in greater detail.

EXAMPLE 1

A mild steel expanded metal with a size of 20 cm×25 cm was plated with copper using an alkali cyanide bath, washed thoroughly, and then plated with nickel in a solution containing 120 g/liter of nickel thiocyanate using platinum as an anode.

Using the resulting cathode and an anode obtained by coating ruthenium oxide on a titanium expanded metal with a size of 20 cm×25 cm, an electrolytic cell was built by setting an ion exchange membrane. ("Nafion", a trademark for a product of Du Pont) between the electrodes to form an anode compartment and a cathode compartment. A 5 N aqueous solution of sodium chloride was fed into the anode compartment, and electrolyzed while pouring water into the cathode compartment so that the catholyte solution became a 6 N aqueous solution of sodium hydroxide.

For comparison, the same electrolysis as above was carried out using a cathode of a mild steel expanded metal (Comparative Example 1) as the cathode, and a styrene/divinylbenzene type sulfonic acid-form cation exchange membrane (Comparative Example 2) as the ion exchange membrane.

The electrolyzing conditions and the results obtained are shown in Table 1.

Table 1

| | Current density ($A/dm^2$) | Electrolyzing temperature (°C.) | Amount of $ClO^-$ in the cathode compartment | | Potential between electrodes (volts) | |
|---|---|---|---|---|---|---|
| | | | Initial | 30 days later | Initial | 30 days later |
| Invention | 30 | 75 - 80 | 1 ppm> | 1 ppm> | 3.52 | 3.53 |
| Comparative Example 1 | 30 | 75 - 80 | 1 ppm> | 1 ppm> | 3.79 | 3.80 |
| Comparative Example 2 | 30 | 75 - 80 | 1 ppm> | 28 ppm | 3.62 | 3.76(*) |

(*)The membrane was exchanged every 10 days.

EXAMPLE 2

Copper plating and nickel thiocyanate plating were performed on a 1 $cm^2$ iron disc in the same way as in Example 1. Using the plated disc as a cathode and platinum as an anode, an electric current was passed at 80° C. and 30 $A/dm^2$ in a 20% by weight aqueous solution of sodium hydroxide. During the operation, the cathode was rotated at a speed of 1,000 rpm. While sodium hypochlorite was added regularly under these conditions so that its concentration at the time of addition became 100 ppm, the hydrogen overvoltage at the cathode was measured periodically. The results are shown in Table 2 and FIG. 1.

Table 2

| Days | 0 | 10 | 13 | 16 | 19 | 20 | 22 | 25 | 40 | 50 |
|---|---|---|---|---|---|---|---|---|---|---|
| NaClO not added | 0.13 | 0.20 | — | — | — | 0.22 | — | — | 0.24 | 0.26 |
| Addition of NaClO | 0.16 | 0.20* | 0.26 | 0.26* | 0.30 | — | 0.28* | 0.32** | 0.44 | — |

*NaClO added in an amount of 100 ppm.
**From 25th to 40th days, NaClO was consecutively added so that its concentration became 100 ppm.

This Example shows that the nickel thiocyanate cathode is especially sensitive to an oxidizing agent.

EXAMPLE 3

A 1.0 mm thick mild steel expanded metal (LW 8, SW 4, slit interval 1 mm) was rolled to form a base structure (120 mm×70 mm). The base structure was polished by emery paper, washed with water, electrically degreased using an aqueous alkali solution, again washed with water, washed with an acid and water, and finally copper-plated under the conditions shown in Table 3.

Table 3

| | |
|---|---|
| CuCN | 22 g/l |
| NaCN | 34 g/l |
| $Na_2CO_3$ | 15 g/l |
| pH | 11.5 |
| Current density | 1.0 $A/dm^2$ |
| Time | 30 minutes |
| Temperature | Room temperature |

As a result, a copper plated layer having a thickness of about 5 microns was formed.

The plated base structure was immersed for several seconds in a 10% aqueous solution of sulfuric acid, washed with water, and then nickel-plated under the conditions shown in Table 4.

Table 4

| | |
|---|---|
| $Ni(SCN)_2$ | 120 g/l |
| Current density | 5 $A/dm^2$ |
| Time | 30 minutes |
| Temperature | 55°-60° C. |

As a result, a cathode having a nickel layer with a thickness of about 20 microns was obtained.

Using the resulting cathode, an anode (120 mm×70 mm) obtained by coating ruthenium oxide on a titanium expanded metal and a perfluoro-type sulfonic acid ion exchange membrane as a diaphragm, an aqueous solution of sodium chloride was electrolyzed under the conditions shown in Table 5. Changes with time of the cell voltage were determined, and the results are shown in Table 6. For comparison, data obtained by using a non-plated mild steel expanded metal as a cathode are also shown.

Table 5

| | |
|---|---|
| Anode compartment | Sodium chloride solution concentration ≈ 200 g/l, pH ≈ 2.5, 80° C. |
| Cathode compartment | NaOH concentration ≈ 240 g/l, 80° C. |
| Current density = 30 $A/dm^2$, Current efficiency = 85 - 87% | |

Table 6

| Number of operating days | 1 | 30 | 60 | 90 | 120 | 150 |
|---|---|---|---|---|---|---|
| Cell including the cathode of the invention (V) | 3.28 | 3.32 | 3.32 | 3.32 | 3.32 | 3.32 |
| Cell including the mild steel cathode (V) | 3.74 | 3.77 | 3.77 | 3.78 | 3.78 | 3.78 |

EXAMPLE 4

Each of the same mild steel expanded metal base structure (50 mm×50 mm) and a flat mild steel sheet (50 mm×500 mm) was directly electroplated with nickel thiocyanate under the same conditions as in Example 3.

Each of these samples was examined for peel strength by a steel wool rubbing test. The nickel coating did not peel off from the mild steel expanded metal, but did from the flat mild steel plate.

The expanded metal cathode obtained and a platinum plate anode were placed in a 20% aqueous solution of sodium hydroxide, and a direct current of 50 A/dm$^2$ was passed at 80° C.±2° C. The cathodic potential was determined in a customary manner by the Luggin Capillary Method using a mercury oxide electrode as a reference. It was found to be −1.25 volts.

EXAMPLE 5

A 6-mesh (Tyler) iron wire gauze (30 mm×20 mm) was directly electroplated with nickel thiocyanate under the same conditions as in Example 4. The nickel layer did not peel off even when brushed by steel wool.

A 1-liter Teflon beaker was charged with 850 ml of a 20% aqueous solution of sodium hydroxide, and changes with time of the cathodic potential were determined as in Example 2. The solution in the beaker was replaced with a new one every 5 days. It was found that the cathodic potential was maintained substantially at −1.24 V throughout a period of 90 days.

EXAMPLE 6

A mild steel sheet (20 mm×20 mm) as a base structure was mechanically polished by emery paper, washed with 15% hydrochloric acid and with water, and then electroplated with nickel. The electroplating was carried out at a current density of 15 A/dm$^2$ and a temperature of 50° C.±2° C. The current was passed for 30 minutes. The hydrogen overvoltage was measured in a 20% aqueous solution of sodium hydroxide at 80° C. by using a platinum plate as a counter electrode and a mercury oxide electrode as a reference electrode.

The above procedure was repeated using various electroplating baths shown in Table 7, and the results are also shown in Table 7.

The abbreviations used in Table 7 have the following meanings.

W: $Na_2WO_4$
Mo: $Na_2MoO_4$
Co: $Co(SCN)_2$
CA: citric acid
AmCl: $NH_4Cl$
Am: $NH_4OH$
NB: $Na_3BO_3$
BA: $H_3BO_3$
AU: $(NH_2)_2CS$
RAm: $(NH_4)SCN$
RK: KSCN
NT: $Na_2S_2O_3$
TGA: thioglycolic acid
NA: nicotinic acid Table 7

| Run No. | Bath composition | pH | Adhesion | Hydrogen overvoltage (V) |
|---|---|---|---|---|
| 1 | $Ni(SCN)_2$ 0.1(mol/l) + CA 0.1 (mol/l) | 1.9 | Poor | — |
| 2 | $Ni(SCN)_2$ 0.1 + Am | 8.5 | Poor | — |
| 3 | $Ni(SCN)_2$ 0.1 + AmCl 50(g/l) | 4.1 | Poor | — |
| 4 | $Ni(SCN)_2$ 0.1 + W 0.22 | — | Poor | — |
| 5 | $Ni(SCN)_2$ 0.1 + CA 0.1 + Am | 8.7 | Good | 0.25–0.26 |
| 6 | $Ni(SCN)_2$ 0.1 + CA 0.1 + NaOH | 8.0 | Poor | — |
| 7 | $Ni(SCN)_2$ 0.1 + CA 0.1 + AmCl 50(g/l) | 2.6 | Good | 0.44 |
| 8 | $Ni(SCN)_2$ 0.1 + CA 0.32 + W 0.22 | 2.5 | Poor | — |
| 9 | $NI(SCN)_2$ 0.1 + Am + AmCl 50(g/l) | 8.5 | Poor | — |
| 10 | $Ni(SCN)_2$ 0.1 + Am + W 0.22 | 8.7 | Poor | — |
| 11 | $Ni(SCN)_2$ 0.1 + AmCl 50(g/l) + W 0.22 | 6.8 | Poor | — |
| 12 | $Ni(SCN)_2$ 0.1 + AmCl 50(g/l) + W 0.22 + CA 0.32 | 2.0 | Poor | — |
| 13 | $Ni(SCN)_2$ 0.1 + AmCl 50(g/l) + W 0.22 + Am | 8.6 | Poor | — |
| 14 | $Ni(SCN)_2$ 0.1 + CA 0.1 + AmCl 50(g/l) + NaOH | 8.7 | Good | 0.247 |
| 15 | $Ni(SCN)_2$ 0.1 + CA 0.32 + Am + W 0.22 | 8.7 | Good | — |
| 16 | $Ni(SCN)_2$ 0.1 + CA 0.1 + AmCl 50(g/l) + Am | 8.7 | Good | 0.21–0.22 |
| 17 | $NiCl_2$ 0.1(mol/l) + CA 0.1 + AmCl 50(g/l) + Am | 8.5 | Good | 0.45 |
| 18 | $NiSO_4$ 0.1(mol/l) + CA 0.1 + AmCl 50(g/l) + Am | 8.5 | Good | 0.52 |
| 19 | $NiCl_2$ 0.1 + CA 0.1 + AmCl 50(g/l) + TU 0.1 + Am | 8.0 | Good | 0.22 |
| 20 | $NiCl_2$ 0.1 + $NiSO_4$ 0.2 + CA 0.3 + NB 50(g/l) + BA + AmCl 50(g/l) + Am | 8.0 | Good | 0.267 |

In the Runs shown in Table 7, Am or NaOH was added until the pH attained the indicated values. The concentration values are in moles/liter unless otherwise specified. The adhesion of the nickel layer was evaluated on a grade of good and poor. Runs Nos. 1 to 4, 6, 8 to 13, 37 and 38 are comparisons.

What we claim is:

1. In an electrolytic cell equipped with a cathode, the improvement wherein said cathode comprises a supporting structure comprising (1) iron, (2) nickel or (3) an alloy composed mainly of at least one member of the group of iron and nickel, said supporting structure having a nickel coating formed thereon by electroplating said supporting structure in a nickel electroplating bath in the presence of an S/N substance, said substance being at least one member selected from the group consisting of a thiocyanate ion, a thiosulfate ion, a dithiocarbamate ion, a thiocarboxylate ion, an amino acid ion, a thiocarbamoyl compound and thiourea wherein the thiocarbamoyl group and the group

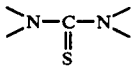

are regarded as anions, and said S/N substance being present in the electroplating bath in an amount of at least 0.1 ion equivalent per equivalent of nickel present as an ion in the bath.

2. An electrolytic cell according to claim 1 wherein said supporting structure of the cathode has a shape such that it does not contain any flat area which extends over more than 10 mm in both the longitudinal and transverse directions.

3. An electrolytic cell according to claim 2 wherein the supporting structure of the cathode is a porous plate.

4. An electrolytic cell according to claim 1 wherein said nickel coating on the cathode is formed by electroplating from a plating bath containing (i) a nickel ion, (ii) a complexing agent, (iii) at least one member of the group of an ammonium ion and a boric acid ion, and (iv) at least one S/N substance selected from the group consisting of a thiocyanate ion, a thiosulfate ion, a dithiocarbamate ion, a thiocarboxylate ion, an amino acid ion, a thiocarbamoyl compound and thiourea.

5. An electrolytic cell according to claim 4 wherein the S/N substance is a thiocyanate ion.

6. An electrolytic cell according to claim wherein the cathode has a nickel coating having a thickness of 5 to 100 microns.

7. An electrolytic cell according to claim 1 wherein said supporting structure of the cathode consists of a base structure of (1) iron, (2) nickel or (3) an alloy composed mainly of at least one member of the group of iron and nickel and having a 2 to 20 micron-thick coating of at least one metal selected from copper and zinc.

8. A cathode for employment in an electrolytic cell which cathode comprises a supporting structure comprising (1) iron, (2) nickel, or (3) an alloy composed mainly of at least one member of the group of iron and nickel, said supporting structure having a nickel coating formed thereon by electroplating said supporting structure in a nickel electroplating bath in the presence of a S/N substance, said substance being at least one member selected from the group consisting of a thiocyanate ion, a thiosulfate ion, a dithiocarbamate ion, a thiocarboxylate ion, an amino acid ion, a thiocarbamoyl compound and thiourea wherein the thiocarbamoyl group and the group

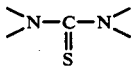

are regarded anions, and said S/N substance being present in the electroplating bath in an amount of at least 0.1 ion equivalent per equivalent of nickel present as an ion in the bath.

* * * * *